US006132170A

United States Patent [19]

Horng

[11] Patent Number: 6,132,170

[45] Date of Patent: Oct. 17, 2000

[54] MINIATURE HEAT DISSIPATING FANS WITH MINIMIZED THICKNESS

[75] Inventor: Alex Horng, Kaohsiung, Taiwan

[73] Assignee: Sunonwealth Electric Machine Industry Co., Ltd., Taiwan

[21] Appl. No.: 09/213,891

[22] Filed: Dec. 17, 1998

[51] Int. Cl.[7] ..... F01D 25/08

[52] U.S. Cl. ..... 415/178; 415/204; 415/213.1; 417/354; 417/423.14; 361/687; 361/695

[58] Field of Search ..... 415/175, 176, 415/177, 178, 204, 206, 208.3, 211.1, 211.2, 213.1, 214.1; 62/259.2; 417/354, 423.14, 423.15; 361/687, 688, 694, 695, 696, 697

[56] References Cited

U.S. PATENT DOCUMENTS

| | | | |
|---|---|---|---|
| 5,699,854 | 12/1997 | Hong | 165/122 |
| 5,940,268 | 8/1999 | Miyahara et al. | 361/697 |
| 5,979,541 | 11/1999 | Saito | 415/178 |

FOREIGN PATENT DOCUMENTS 324798 2/1998 Taiwan .

*Primary Examiner*—Edward K. Look
*Assistant Examiner*—Liam McDowell
*Attorney, Agent, or Firm*—Stevens, Davis, Miller & Mosher, L.L.P.

[57] ABSTRACT

A heat dissipating fan includes a casing, a stator seat, a fan wheel, and a lid. The casing includes a compartment for receiving the fan wheel, and a bottom wall that defines the compartment has an axle tube formed thereon. The casing further includes an air outlet defined in an end edge thereof and communicated with the compartment. The fan wheel includes a number of blades and an axle that is rotatably received in the axle tube. The lid is engaged on top of the casing and includes an air inlet. Each blade includes an upper section extended beyond the air inlet, while a lower section of each blade is below the lid. When the fan wheel rotates, ambient air is driven into the casing via the air inlet of the lid to carry heat in the casing away via the air outlet of the casing. The heat dissipating fan may drive more air by increasing an active area of the blades with reduced noise.

11 Claims, 14 Drawing Sheets

MINIATURE HEAT DISSIPATING FANS WITH MINIMIZED THICKNESS

BACKGROUND OF THE INVENTION

1. Field of the Invention

The present invention relates to miniature heat dissipating fans with minimized thickness, and more particularly for miniature heat dissipating fans with minimized thickness for notebook computers.

2. Description of the Related Art

A wide variety of fan wheels for miniature heat dissipating fans have heretofore been provided, e.g., Taiwan Invention Patent Publication No. 324798 issued on Jan. 11, 1998. Said Taiwan Invention Patent Publication No. 324798 discloses a cooling fan comprising an outer casing with an opening covered by a lid. A fan is mounted in the outer casing and includes a stator seat and a rotor having a number of blades extended radially therefrom. Heat is carried away upon rotation of the fan in which air is driven into the casing via the opening to a heat dissipating section formed on a side of the casing. The heat dissipating fan disclosed in Taiwan Invention Patent Publication No. 324798 is featured by that: (a) the blades have an outer maximal diameter section greater than the inner diameter of the opening, (b) the rotating blades do not contact with the lid, (c) the blades have a minimal diameter section smaller than the inner diameter of the opening, and (d) at least a portion of the minimal diameter section is located inside the opening. Nevertheless, when applying such heat dissipating fan to a notebook computer, as shown in FIG. 1 of the drawings, the fan and the computer casing 2 has a relatively small gap therebetween for sucking air. As a result, the amount of air driven by the fan is relatively small, and noise may occur during rotation of the blades.

The present invention is intended to provide miniature heat dissipating fans with minimized thickness for notebook computers that mitigate and/or obviate the above-mentioned problems.

SUMMARY OF THE INVENTION

It is a primary object of the present invention to provide an improved miniature heat dissipating fan with minimized thickness that has an increased blade area in a limited space to increase the amount of air driven, thereby improving the cooling effect.

It is another object of the present invention to provide an improved miniature heat dissipating fan with minimized thickness that may drive more air and reduce noise during rotation of the blades.

It is a further object of the present invention to provide an improved miniature heat dissipating fan with minimized thickness that may provide better convection effect.

In accordance with the present invention, a heat dissipating fan comprises a casing, a stator seat, a fan wheel, and a lid. The casing includes a compartment for receiving the fan wheel, and a bottom wall that defines the compartment has an axle tube formed thereon. The casing further includes an air outlet defined in an end edge thereof and having an appropriate shape. The stator seat is mounted to the axle tube and includes polar plates, a circuit board, and a coil seat mounted thereon. The fan wheel includes a number of blades and an axle that is rotatably received in the axle tube. The lid is engaged on top of the casing and includes an air inlet. Each blade includes an upper edge partially extended beyond the air inlet, while the remaining portion thereof is below the lid. The upper edge inclines at an appropriate angle. Since the upper section of each blade extends beyond the lid, the computer housing and the lid may have a larger gap therebetween for ambient air to enter the air inlet of the lid via the larger gap.

In addition, each blade of the fan wheel includes an upper section and a lower section. The upper section of each blade is connected to the fan wheel at an arcuate end edge that extends in an angle with an axial direction of the axle. The lower section of each blade is connected to the fan wheel at a rectilinear end edge that extends along a direction parallel to the axial direction of the axle. When the fan wheel rotates, the upper sections of the blades generate an air flow along the axial direction, while the lower sections of the blades generate an air flow perpendicular to the axial direction. Upon rotation of the fan wheel, a circulating convection effect is obtained in the casing. Thus, air is sucked from a location above the blades and exits via a lateral side of the blades, thereby forming a better air passage. The heat dissipating fan in accordance with the present invention may drive more air with reduced noise.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
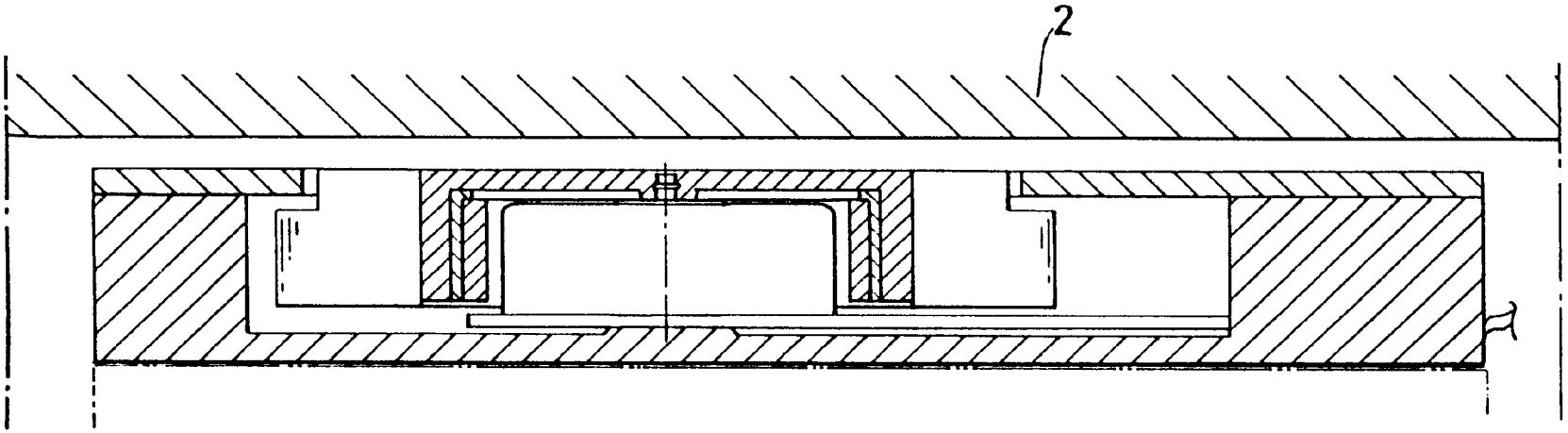
PRIOR ART FIG.1
FIG. 1 is a sectional view illustrating use of a conventional heat dissipating fan in a notebook computer.
Figure 2:
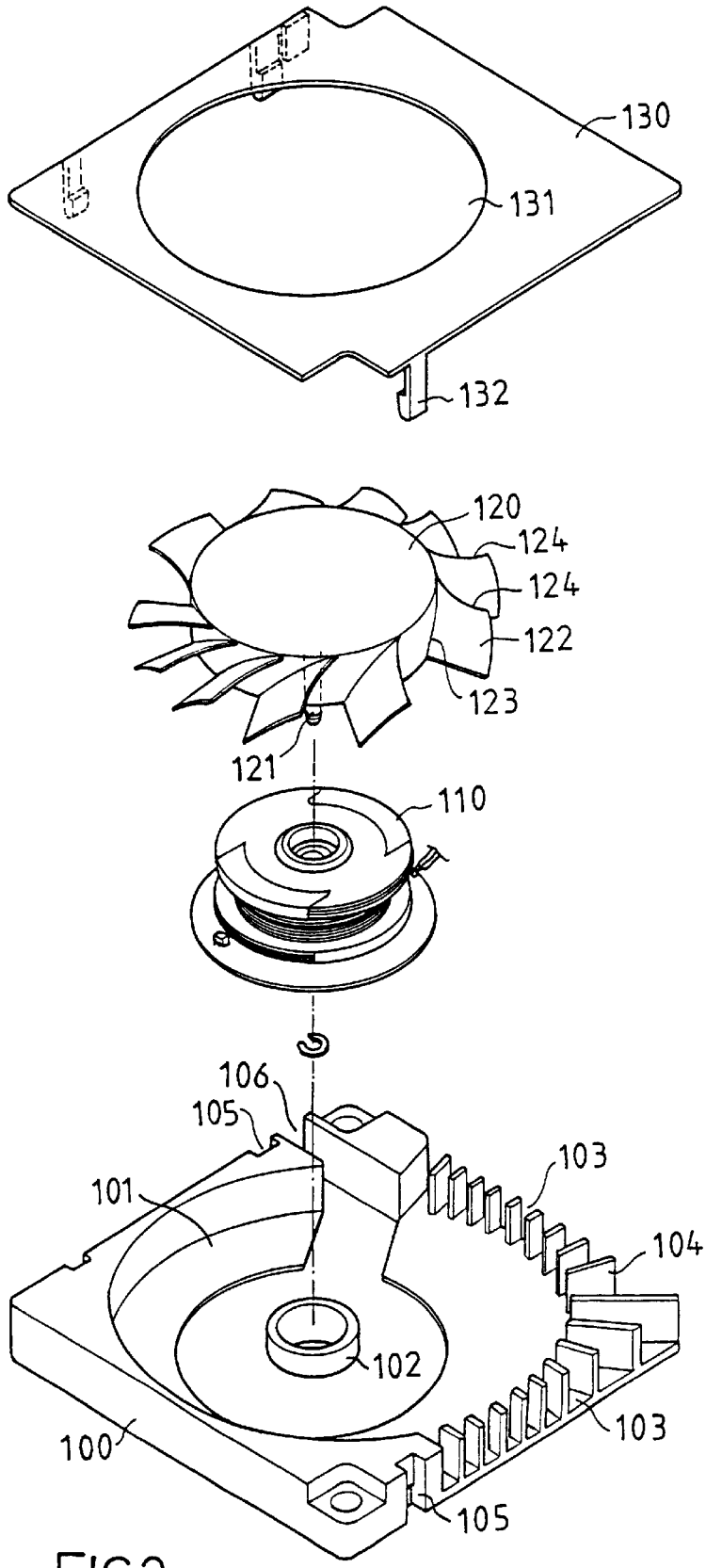
FIG. 2 is an exploded perspective view of a first embodiment of a miniature heat dissipating fan in accordance with the present invention.
Figure 3:
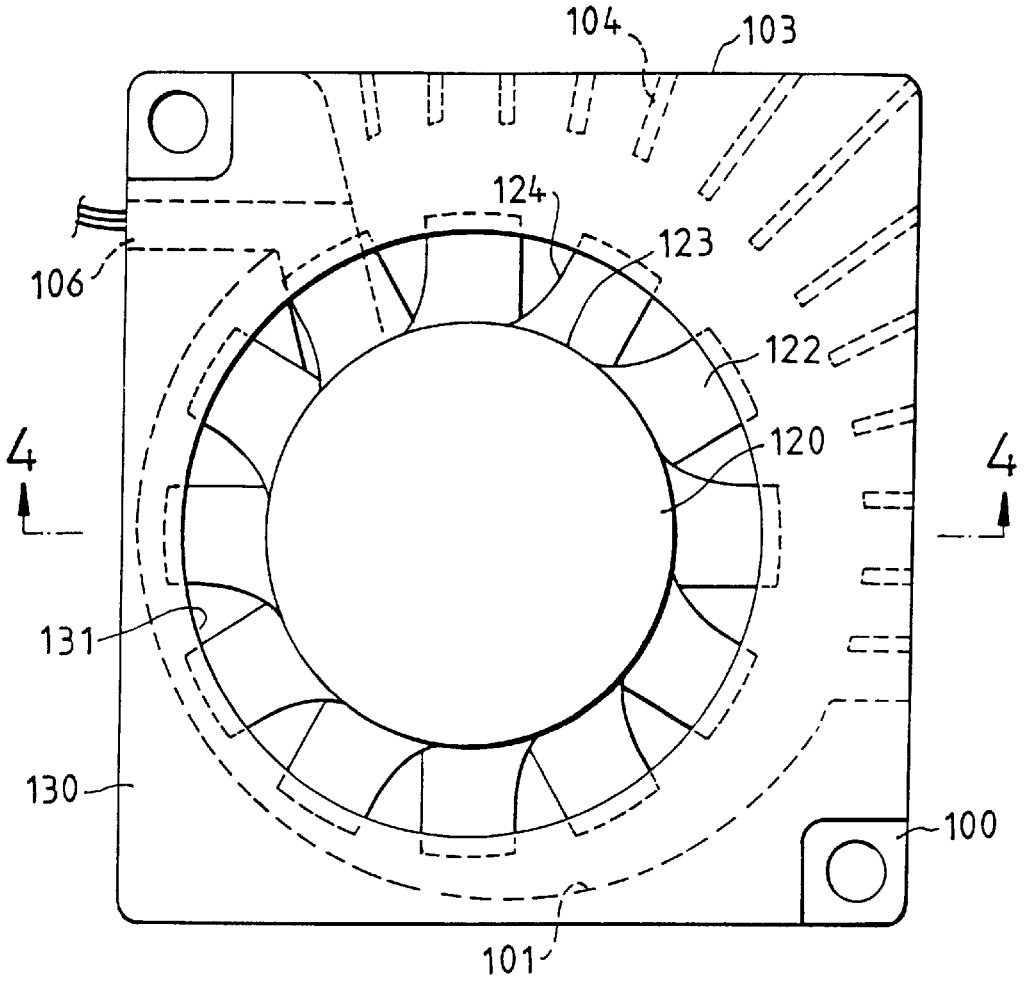
FIG. 3 is a top view of the miniature heat dissipating fan in FIG. 2.
Figure 4:
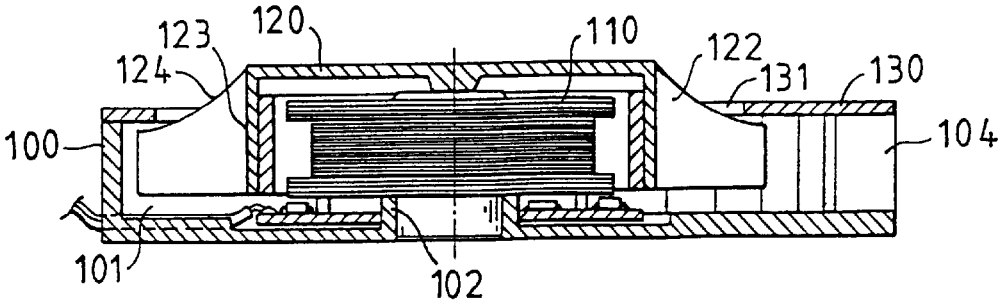
FIG. 4 is a sectional view taken along line 4—4 in FIG. 3.

Referring to FIGS. 2 to 4, a first embodiment of a miniature heat dissipating fan in accordance with the present invention generally includes a casing 100, a stator seat 110, a fan wheel 120, and a lid 130. The casing 100 includes a compartment 101 and a channel 106. The channel 106 allows insertion of power lines or power supplying elements. A bottom wall that defines the compartment 101 includes an axle tube 102 formed thereon, which will be described later. The casing 100 further includes at least one air outlet 103 defined in a periphery thereof. In this embodiment, there are two air outlets 103 respectively formed in two sides of the casing 100 to face two vertical walls of a notebook computer housing. In addition, a number of guide plates 104 are provided in each air outlet 103 to guide air to exit the casing 100, increase the heat dissipating effect, and prevent alien objects from entering the casing 100. If necessary, all of four sides of the casing 100 may have air outlets 103. Alternatively, the casing 100 may be designed to guide air to an air outlet along a specific direction. The casing 100 further includes a number of notches 105 defined in a periphery thereof, which will be described later.

The stator seat 110 is mounted in the compartment 101 and fixed to the axle tube 102 of the casing 100. Mounted on the stator seat 110 are upper and lower polar plates (not labeled), a circuit board (not labeled), and a coil seat (not labeled). The fan wheel 120 includes a main body (not labeled) with a peripheral wall (not labeled) and an axle 121 located at a center of the main body. The axle 121 is rotatably received in the stator seat 110. A number of blades 122 are annularly and spacedly provided along the peripheral wall of the fan wheel 120. In this embodiment, each blade 122 is connected with the peripheral wall at an end edge 123, while each blade 122 includes an inclined upper edge 124.

The lid 130 includes an air inlet 131 and a number of hooked fastener 132 for releasable engagement with the notches 105 of the casing 100. Referring to FIG. 4, a portion of the upper edge 124 of each blade 122 extends upwardly beyond the air inlet 131, while the remaining portion of the upper edge 124 of each blade 122 is below the lid 130.

Figure 5:
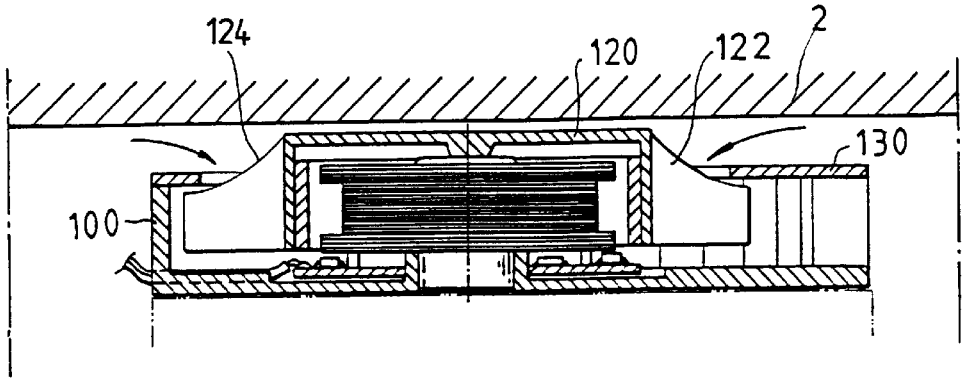
FIG. 5 is a sectional view illustrating use of the miniature heat dissipating fan in FIG. 2 in a notebook computer.
Figure 6:
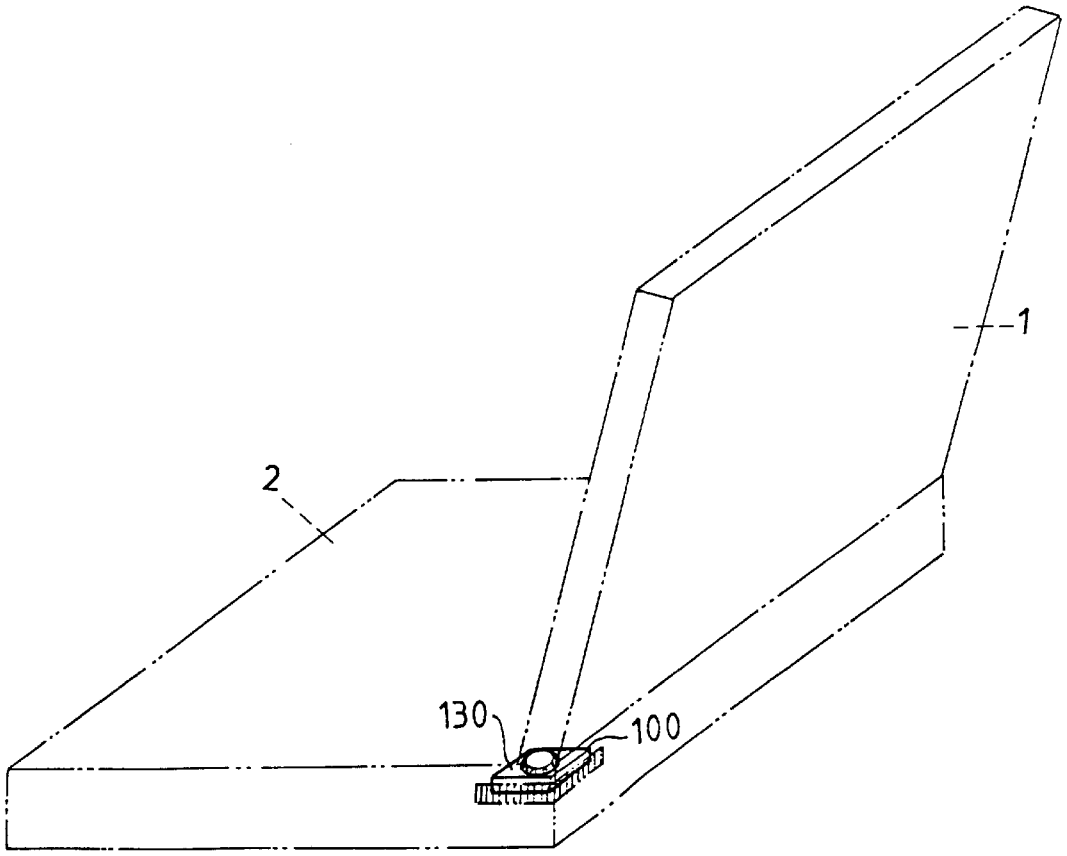
FIG. 6 is a schematic perspective view illustrating use of the miniature heat dissipating fan in a notebook computer.

When the miniature heat dissipating fan is applied to a notebook computer 1 (FIG. 6), since a portion of the upper edge 124 of each blade 122 extends beyond the lid 130, the level of the lid 130 can be lowered, which is advantageous in a limited space. In addition, a larger gap between the lid 130 and a housing 2 of the notebook computer 1 is obtained, best shown in FIG. 5. Accordingly, ambient air may enter the air inlet 131 of the lid 130 via a larger gap. This may largely prevent the air from being slowed down resulting from viscous flow when passing through a small gap. In addition, since a portion of the upper edge 124 of each blade 122 extends beyond the lid 130, the active area of the blades 122 increases, i.e., the amount of air driven by the blades 122 is increased.

In operation, upon rotation of the fan wheel 120, ambient cool air is sucked into the casing 100 by the blades 122 via the gap between the computer housing 2 and the lid 130 and the air inlet 131 of the lid 130 and carries heat in the casing 100 away. Then, hot air as a result of absorbing heat generated inside the notebook computer 1 is driven to exit the casing 100 via the air outlets 103. It is appreciated that the noise during rotation of the blades 122 is reduced, as the notebook computer casing 2 and the fan blades 122 have a larger space therebetween.

Figure 7:
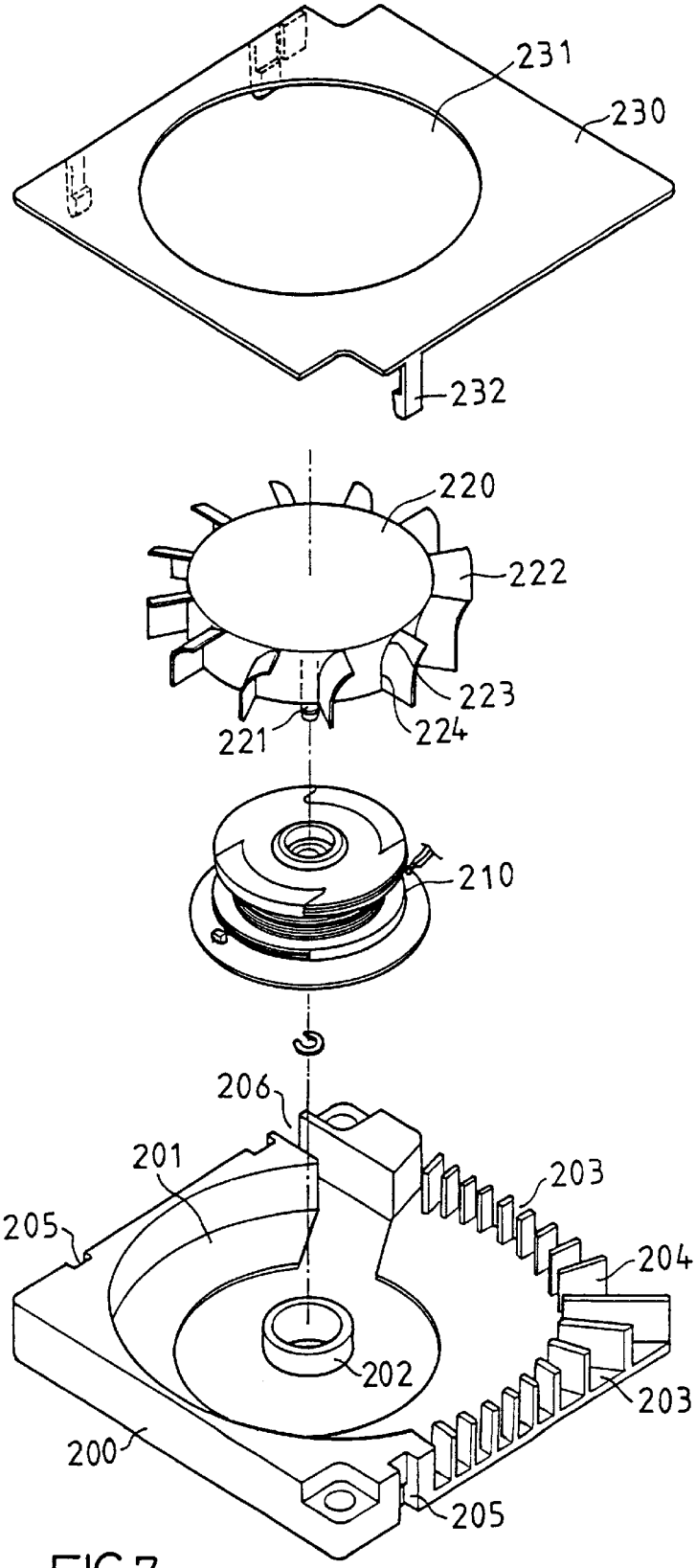
FIG. 7 is an exploded perspective view of a second embodiment of a miniature heat dissipating fan in accordance with the present invention.
Figure 8:
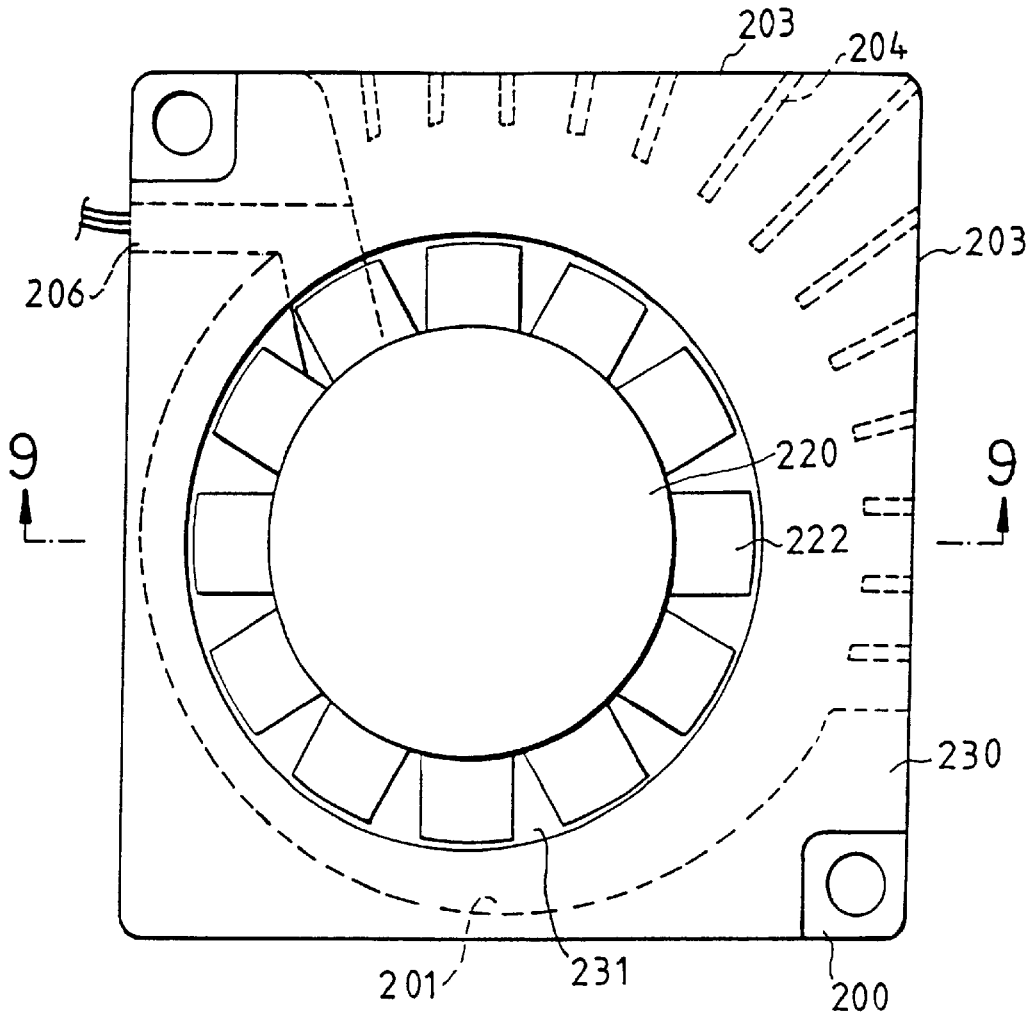
FIG. 8 is a top view of the miniature heat dissipating fan in FIG. 7.
Figure 9:
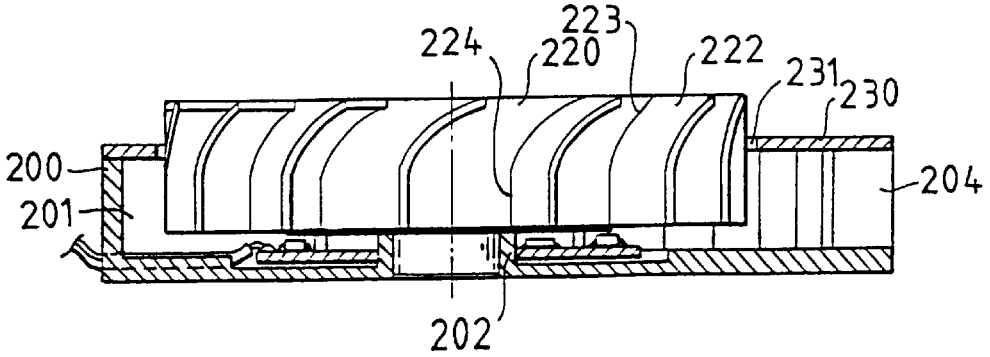
FIG. 9 is a sectional view taken along line 9—9 in FIG. 8.

Referring to FIGS. 7 to 9, a second embodiment of a miniature heat dissipating fan in accordance with the present invention generally includes a casing 200, a stator seat 210, a fan wheel 220, and a lid 230. The casing 200 includes a compartment 201 and a channel 206. The channel 206 allows insertion of power lines or power supplying elements. A bottom wall that defines the compartment 201 includes an axle tube 202 formed thereon, which will be described later. The casing 200 further includes at least one air outlet 203 defined in a periphery thereof. In this embodiment, there are two air outlets 203 respectively formed in two sides of the casing 200 to face two vertical walls of a notebook computer housing. In addition, a number of guide plates 204 are provided in each air outlet 203 to guide air to exit the casing 200, increase the heat dissipating effect, and prevent alien objects from entering the casing 200. If necessary, all of four sides of the casing 200 may have air outlets 203. Alternatively, the casing 200 may be designed to guide air to an air outlet along a specific direction. The casing 200 further includes a number of notches 205 defined in a periphery thereof, which will be described later.

The stator seat 210 is mounted in the compartment 201 and fixed to the axle tube 202 of the casing 200. Mounted on the stator seat 210 are upper and lower polar plates (not labeled), a circuit board (not labeled), and a coil seat (not labeled). The fan wheel 220 includes a main body (not labeled) with a peripheral wall (not labeled) and an axle 221 located at a center of the main body. The axle 221 is rotatably received in the stator seat 210. A number of blades 222 are annularly and spacedly provided along the peripheral wall of the fan wheel 220. In this embodiment, each blade 222 is connected with the peripheral wall at an end edge and includes an upper section 223 and a lower section 224. The lower section 224 is rectilinear and extends in a direction parallel to the axial direction of the axle 221, while the upper section 223 is inclined and arcuate.

The lid 230 includes an air inlet 231 and a number of hooked fastener 232 for releasable engagement with the notches 205 of the casing 200. Referring to FIG. 9, most of the upper section 223 of each blade 222 extends upwardly beyond the lid 230. The lower section 224 of each blade 222 is below the lid 230.

When the miniature heat dissipating fan is applied to a notebook computer, since most of the upper section 223 of each blade 222 extends beyond the lid 230, the level of the lid 230 can be lowered, which is advantageous in a limited space. In addition, a larger gap between the lid 230 and the notebook computer housing is obtained, (see FIG. 5 for reference). Accordingly, ambient air may enter the air inlet 231 of the lid 230 via a larger gap. This may largely prevent the air from being slowed down resulting from viscous flow when passing through a small gap. In addition, since the upper section 223 of each blade 222 extends beyond the lid 230, the active area of the blades 222 increases, i.e., the amount of air driven by the blades 222 is increased. Preferably, the upper section 223 of each blade 222 is substantially rectangular to provide a maximal active area. Furthermore, the upper section 223 is of axial type that may drive ambient air into the opening 231 along the axial direction of the axle 221. The lower section 224 of each blade 222 is below the lid 230. Ambient air that has been driven into the casing 200 by the upper sections 223 is driven by the lower sections 224 along a plane perpendicular to the axial direction, thereby forming an air flow with better circulating effect.

In operation, upon rotation of the fan wheel 220, ambient cool air is sucked into the casing 200 by the upper sections 223 of the blades 222 via the gap between the computer housing and the lid 230 and the air inlet 231 of the lid 230 and driven along the axial direction to carry heat in the casing 200 away. Then, hot air as a result of absorbing heat generated inside the notebook computer is driven by the lower sections 224 along a plane perpendicular to the axial direction to exit the casing 200 via the air outlets 203.

Figure 10:
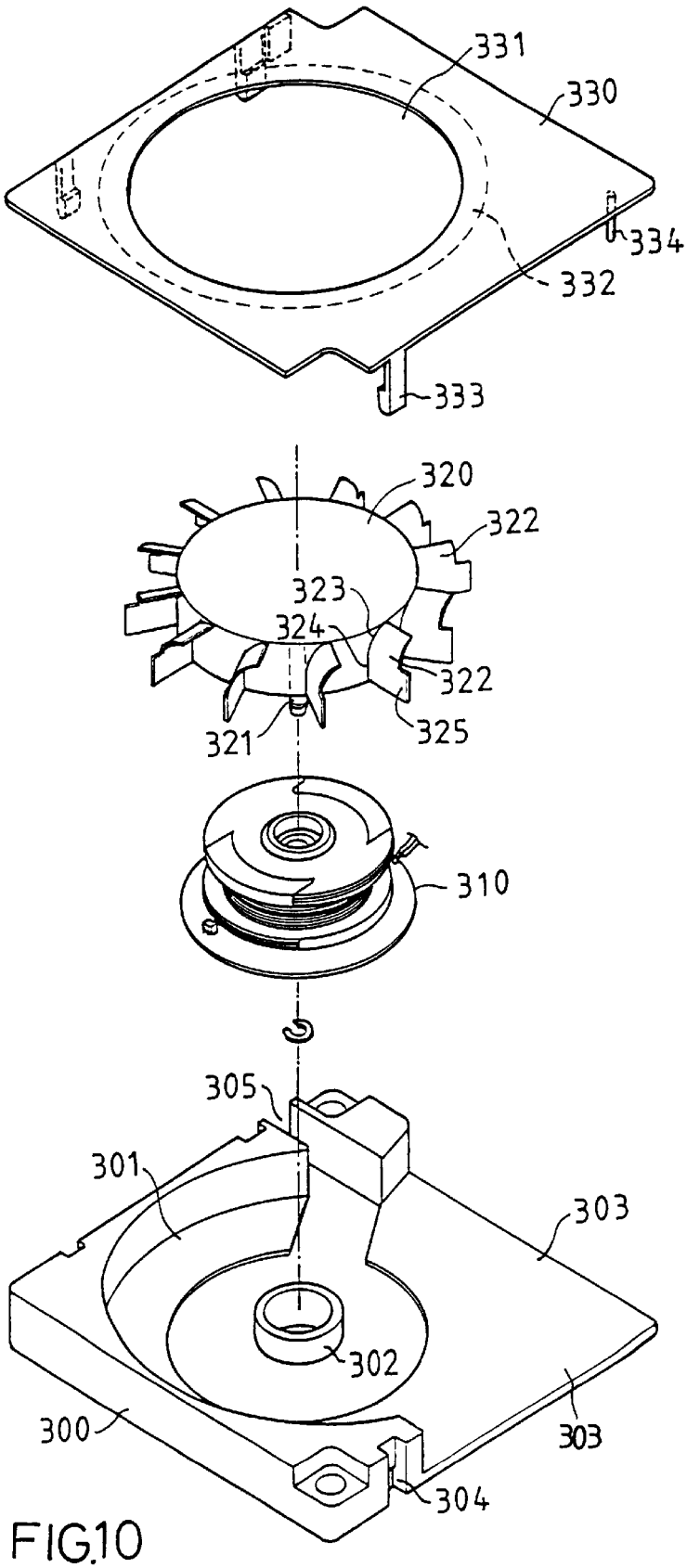
FIG. 10 is an exploded perspective view of a third embodiment of a miniature heat dissipating fan in accordance with the present invention.
Figure 11:
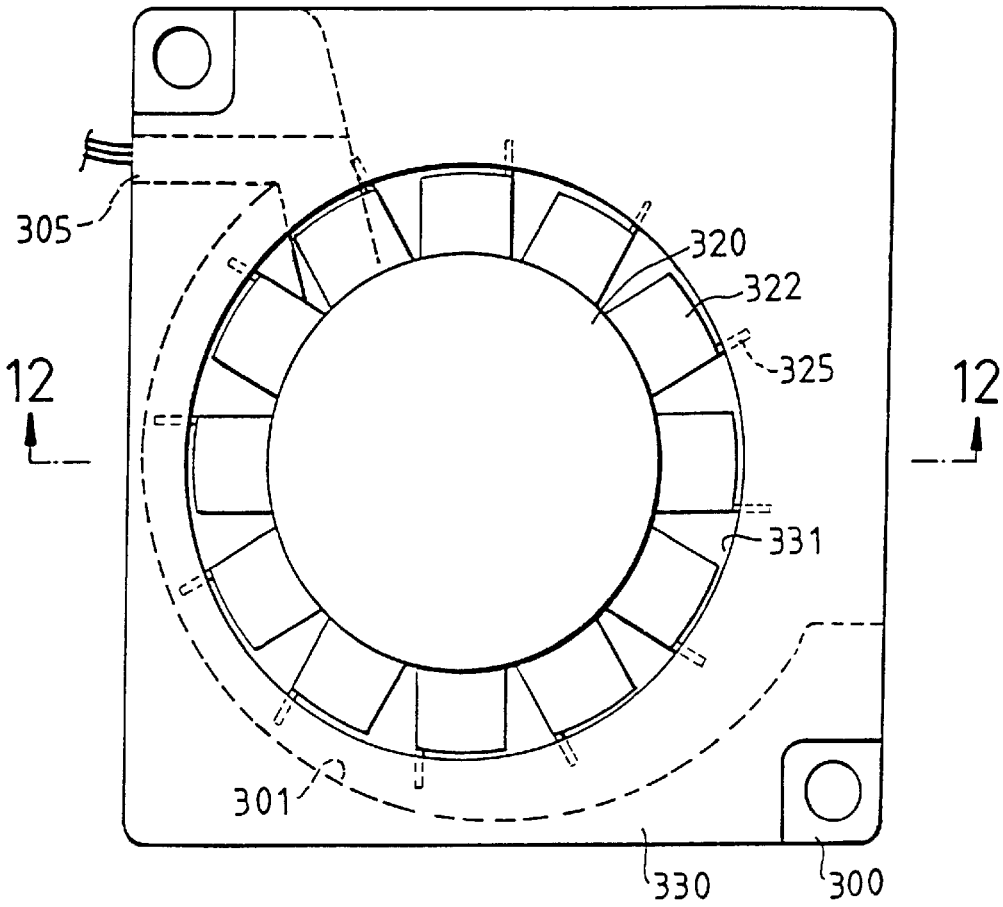
FIG. 11 is a top view of the miniature heat dissipating fan in FIG. 10.
Figure 12:
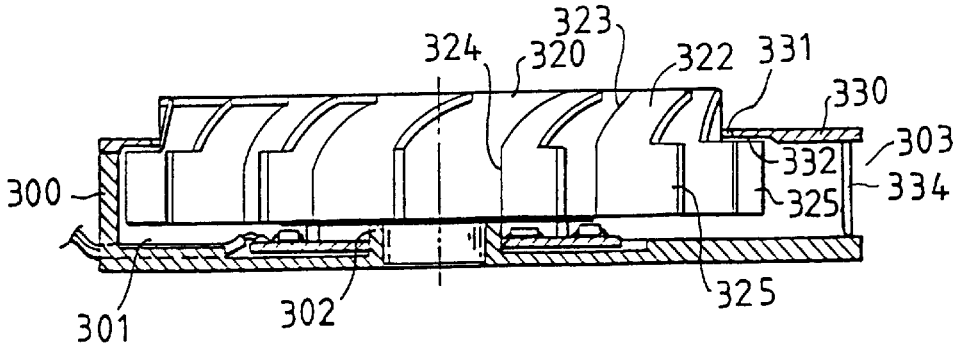
FIG. 12 is a sectional view taken along line 12—12 in FIG. 11.

Referring to FIGS. 10 to 12, a third embodiment of the miniature heat dissipating fan in accordance with the present invention generally includes a casing 300, a stator seat 310, a fan wheel 320, and a lid 330. The casing 300 includes a compartment 301 and a channel 305. The channel 305 allows insertion of power lines or power supplying elements. A bottom wall that defines the compartment 301 includes an axle tube 302 formed thereon, which will be described later. The casing 300 further includes at least one air outlet 303 defined in a periphery thereof. In this embodiment, there are two air outlets 303 respectively formed in two sides of the casing 300 to face two vertical walls of a computer housing. If necessary, all four sides of the casing 300 may have air outlets 303. Alternatively, the casing 300 may be designed to guide air to an air outlet along a specific direction. The casing 300 further includes a number of notches 304 defined in a periphery thereof, which will be described later.

The stator seat 310 is mounted in the compartment 301 and fixed to the axle tube 302 of the casing 300. Mounted on the stator seat 310 are upper and lower polar plates (not labeled), a circuit board (not labeled), and a coil seat (not labeled). The fan wheel 320 includes a main body (not labeled) with a peripheral wall (not labeled) and an axle 321 located at a center of the main body. The axle 321 is rotatably received in the stator seat 310. A number of blades 322 are annularly and spacedly provided along the peripheral wall of the fan wheel 320. In this embodiment, each blade 322 is connected with the peripheral wall at an end edge and includes an upper section 323 and a lower section 324. The upper section 323 extends in a direction at an angle with an axial direction, and the lower section 324 is rectilinear and extends in a direction parallel to the axial direction of the axle 321. In addition, each lower section 324 includes a radial extension 325 to increase the active area for driving air.

The lid 330 includes an air inlet 331 and a number of hooked fastener 332 for releasable engagement with the notches 304 of the casing 300. Most of each upper section 323 extends beyond the lid 330, best shown in FIG. 12. In addition, the lid 330 includes a number of pegs 334 that rest on a bottom wall defining the air outlets 303. The lid 330 further includes a recessed area 332 around the air inlet 331 for accommodating the radial extension 325 of each lower section 324 below the lid 330. This may increase the effective area of the upper blades 324 and thus increase the amount of air driven by the lower sections 324.

When the miniature heat dissipating fan is applied to a notebook computer, since most of the upper section 323 of each blade 322 extends beyond the lid 330, the level of the lid 330 can be lowered, which is advantageous in a limited space. In addition, a larger gap between the lid 330 and the notebook computer housing is obtained (see FIG. 5 for reference). Accordingly, ambient air may enter the air inlet 331 of the lid 330 via a larger gap. This may largely prevent the air from being slowed down resulting from viscous flow when passing through a small gap. In addition, since the upper section 323 of each blade 322 extends beyond the lid 330, the active area of the blades 322 increases, i.e., the amount of air driven by the blades 322 is increased. Furthermore, the upper section 323 of each blade 322 may drive ambient air into the opening 331 along the axial direction of the axle 321. The lower section 324 of each blade 322 is below the lid 330. The radial extension 325 of each lower section 324 is below the recessed area 332 of the lid 330. Ambient air that has been driven into the casing 300 by the upper sections 323 is driven by the lower sections 324 along a plane perpendicular to the axle 321, thereby forming a circulating air flow.

In operation, upon rotation of the fan wheel 320, ambient cool air is sucked into the casing 300 by the upper sections 323 of the blades 322 via the gap between the computer housing and the lid 330 and the air inlet 331 of the lid 330 and driven along the axial direction of the axle 321 to carry heat in the casing 300 away. Then, hot air as a result of absorbing heat generated inside the notebook computer is driven by the lower sections 324 along a plane perpendicular to the axial direction to exit the casing 300 via the air outlets 303.

Figure 13:
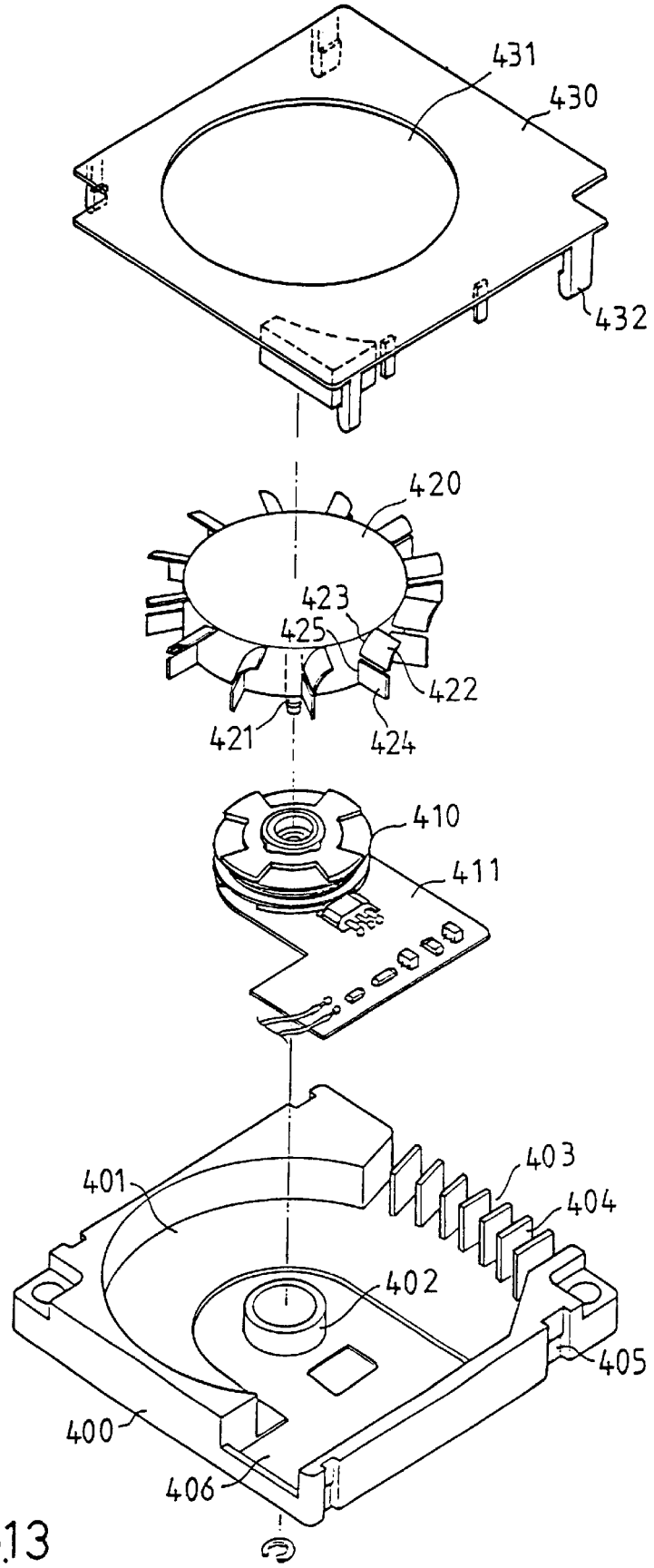
FIG. 13 is an exploded perspective view of a fourth embodiment of a miniature heat dissipating fan in accordance with the present invention.
Figure 14:
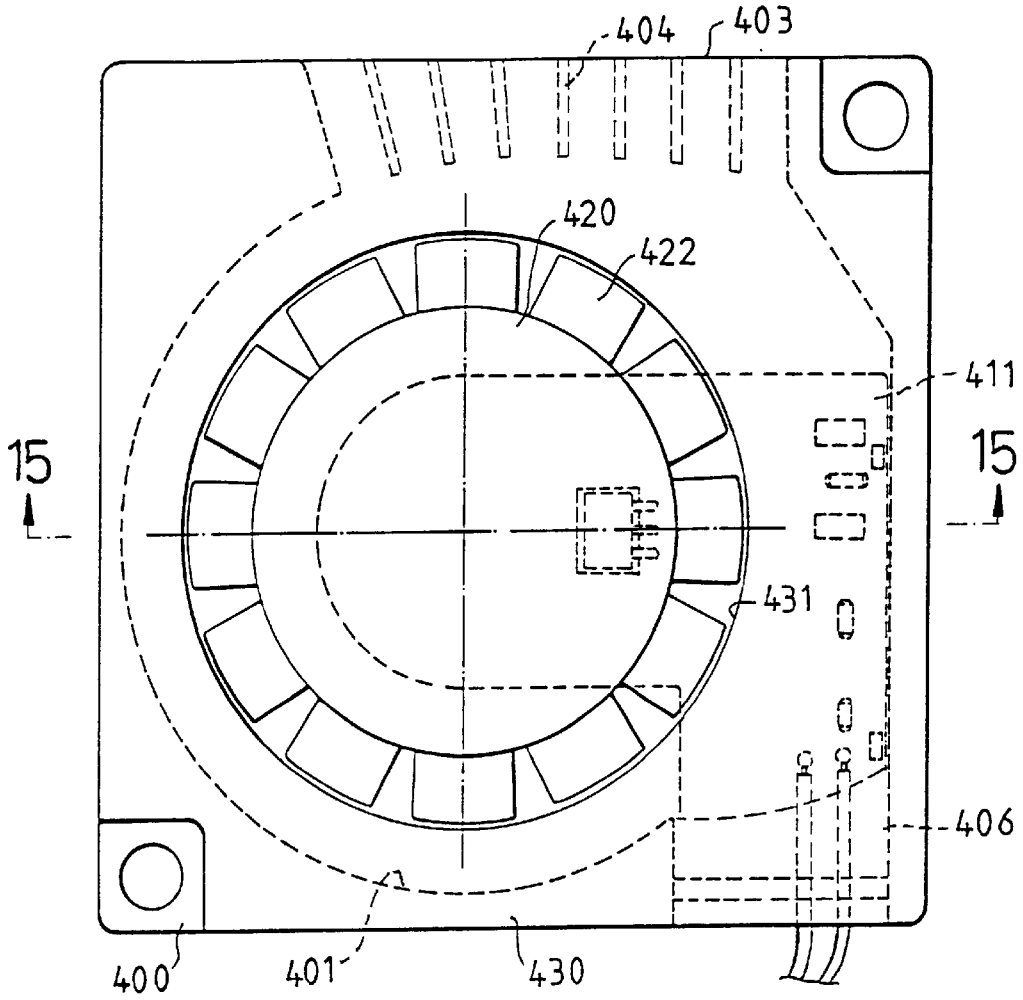
FIG. 14 is a top view of the miniature heat dissipating fan in FIG. 13.
Figure 15:
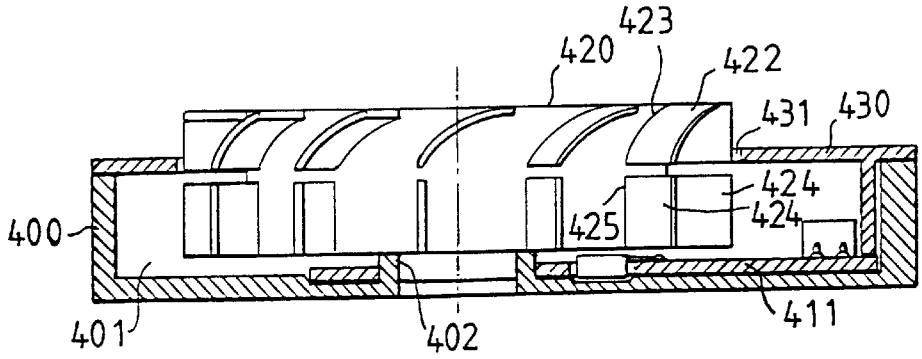
FIG. 15 is a sectional view taken along line 15—15 in FIG. 14.

Referring to FIGS. 13 to 15, a fourth embodiment of a miniature heat dissipating fan in accordance with the present invention generally includes a casing 400, a stator seat 410, a fan wheel 420, and a lid 430. The casing 400 includes a compartment 401 and a channel 406. The channel 406 allows insertion of power lines or power supplying elements. A bottom wall that defines the compartment 401 includes an axle tube 402, which will be described later. The casing 400 further includes at least one air outlet 403 defined in a periphery thereof. In this embodiment, there is an air outlet 403 formed in a side of the casing 400. In addition, a number of guide plates 404 are provided in the air outlet 403 to guide air to exit the casing 400, increase the heat dissipating effect, and prevent alien objects from entering the casing 400. If necessary, all of four sides of the casing 400 may have air outlets 403. Alternatively, the casing 400 may be designed to guide air to an air outlet along a specific direction. The casing 400 further includes a number of notches 405 defined in a periphery thereof, which will be described later.

The stator seat 410 is mounted in the compartment 401 and fixed to the axle tube 402 of the casing 400. Mounted on the stator seat 410 are upper and lower polar plates (not labeled), a circuit board 411, and a coil seat (not labeled). The circuit board 411 may have elements mounted in an area outside the stator seat 410 to reduce the thickness of the stator seat 410 as well as the overall thickness of the heat dissipating fan. The fan wheel 420 includes a main body (not labeled) with a peripheral wall (not labeled) and an axle 421 located at a center of the main body. The axle 421 is rotatably received in the stator seat 410. A number of upper blades 422 and a number of lower blades 424 are annularly and spacedly provided along the peripheral wall of the fan wheel 420. In this embodiment, each upper blade 422 is connected to the peripheral wall of the fan wheel 420 at an end edge 423, and each lower blade 424 is connected to the peripheral wall of the fan wheel 420 at an end edge 425. In addition, the end edge 423 of each upper blade 422 extends in a direction at an angle with an axial direction of the axle 421. Preferably, each upper blade 422 is arcuate. The end edge 425 of each lower blade 425 extends in a direction substantially parallel to the axial direction of the axle 421.

The lid 430 includes an air inlet 431 and a number of hooked fastener 432 for releasable engagement with the notches 405 of the casing 400. Referring to FIG. 15, most of each upper blade 422 extends upwardly beyond the lid 430, while the lower blades 424 are below the lid 430.

When the miniature heat dissipating fan is applied to a notebook computer, since most of each upper blade 422 extends beyond the lid 430, the level of the lid 430 can be lowered, which is advantageous in a limited space. In addition, a larger gap between the lid 430 and the notebook computer housing is obtained (see FIG. 5 for reference). Accordingly, ambient air may enter the air inlet 431 of the lid 430 via a larger gap. This may largely prevent the air from being slowed down resulting from viscous flow when passing through a small gap. In addition, since each upper blade 422 extends beyond the lid 430, the active area of the upper blades 422 increases, i.e., the amount of air driven by the upper blades 422 is increased. Furthermore, the upper blades 422 may drive ambient air into the air inlet 431 along the axial direction of the axle 421. Preferably, each upper blade 422 is substantially rectangular to provide a maximal active area. Furthermore, the upper blades 423 may drive ambient air into the air inlet 431 along the axial direction of the axle 421. The lower blades 424 are below the lid 430. Ambient air that has been driven into the casing 400 by the upper blades 423 is driven by the lower blades 424 along a plane perpendicular to the axial direction of the axle 421, thereby forming a circulating air flow.

In operation, upon rotation of the fan wheel 420, ambient cool air is sucked into the casing 400 by the upper blades 422 via the gap between the computer housing and the lid 430 and the air inlet 431 of the lid 430 and driven along the axial direction of the axle 421 to carry heat in the casing 400 away. Then, hot air as a result of absorbing heat generated inside the notebook computer is driven by the lower blades 424 along a plane perpendicular to the axial direction of the axle 421 to exit the casing 400 via the air outlet 403. In order to increase the amount of air driven, the lower blades 422 may have an outer diameter greater than an inner diameter of the air inlet 431 to increase the area of each lower blade 422.

Figure 16:
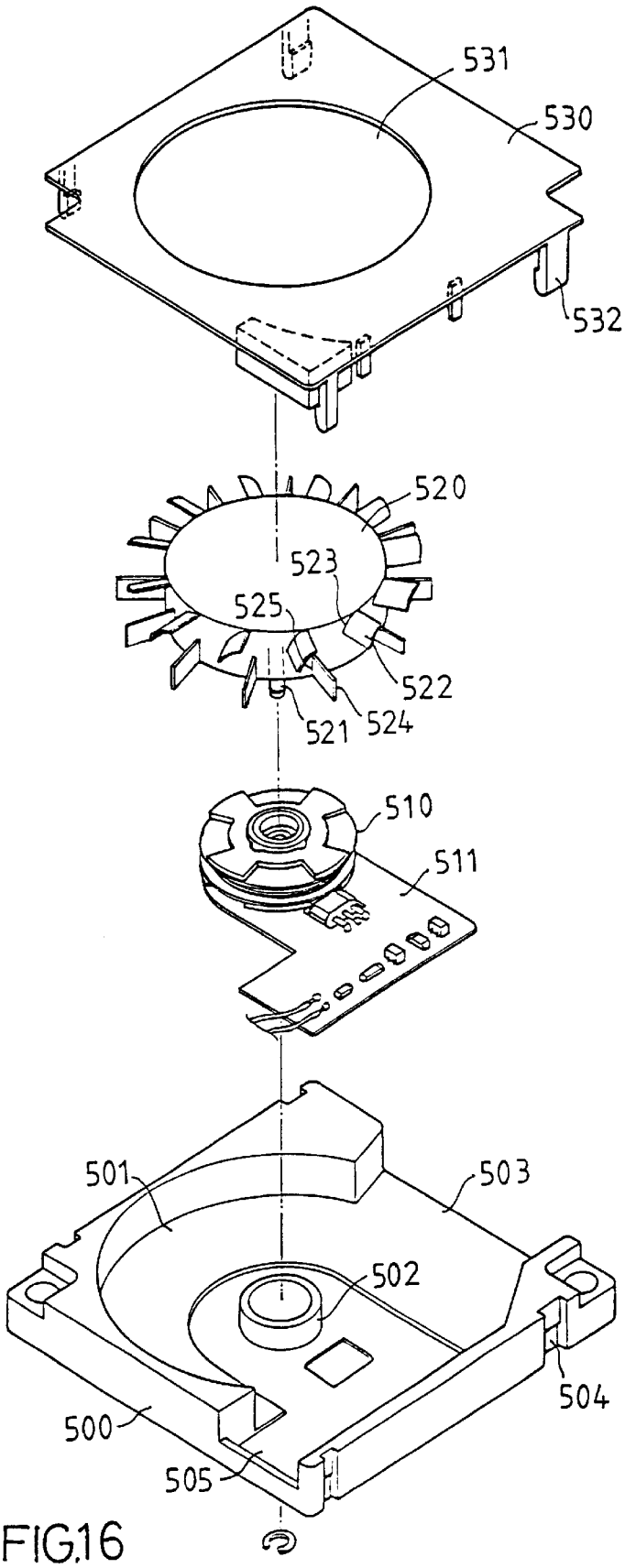
FIG. 16 is an exploded perspective view of a fifth embodiment of a miniature heat dissipating fan in accordance with the present invention.
Figure 17:
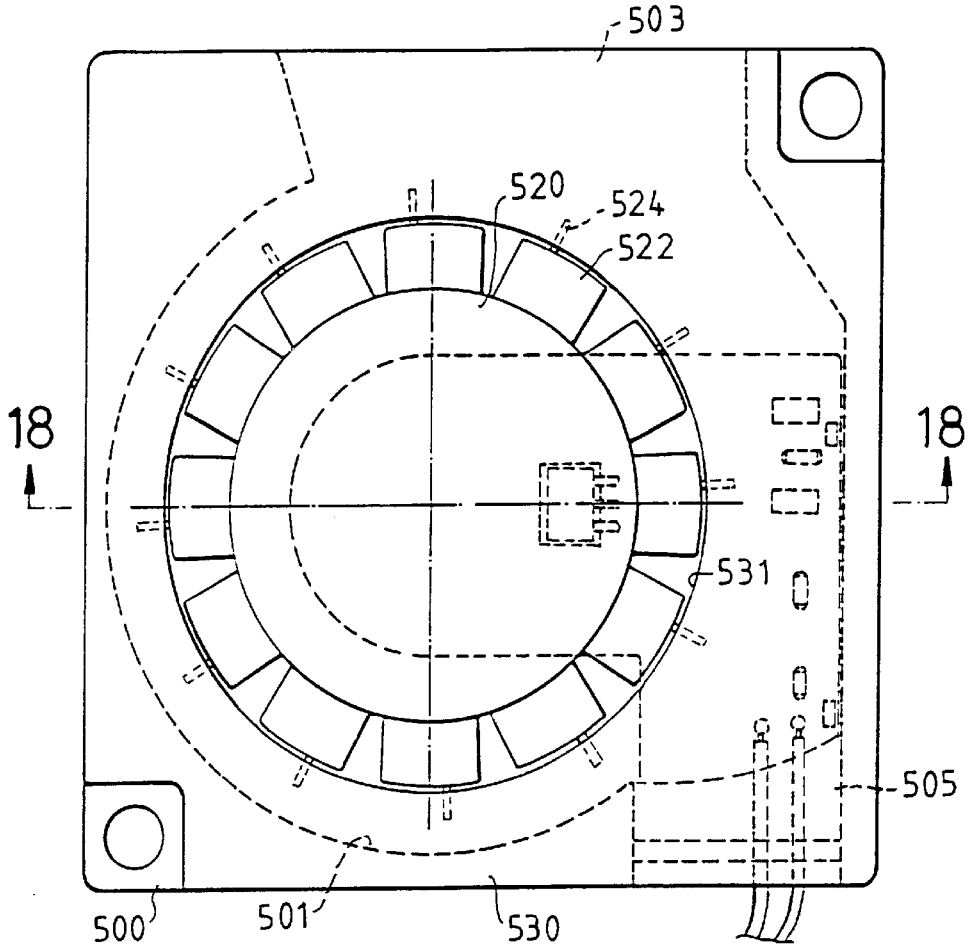
FIG. 17 is a top view of the miniature heat dissipating fan in FIG. 16.
Figure 18:
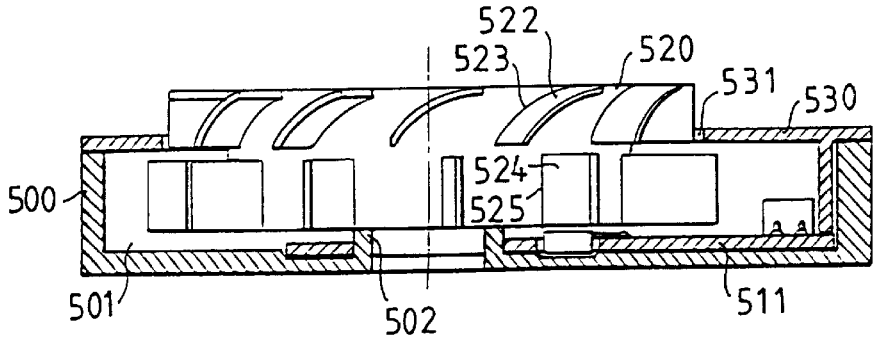
FIG. 18 is a sectional view taken along line 18—18 in FIG. 17.

Referring to FIGS. 16 to 18, a fifth embodiment of a miniature heat dissipating fan in accordance with the present invention generally includes a casing 500, a stator seat 510, a fan wheel 520, and a lid 530. The casing 500 includes a compartment 501 and a channel 505. The channel 505 allows insertion of power lines or power supplying elements. A bottom wall that defines the compartment 501 includes an axle tube 502, which will be described later. The casing 500 further includes at least one air outlet 503 defined in a periphery thereof In this embodiment, there is an air outlet 503 formed in a side of the casing 500. If necessary, all of four sides of the casing 500 may have air outlets 503. Alternatively, the casing 500 may be designed to guide air to an air outlet along a specific direction. The casing 500 further includes a number of notches 504 defined in a periphery thereof, which will be described later.

The stator seat 510 is mounted in the compartment 501 and fixed to the axle tube 502 of the casing 500. Mounted on the stator seat 510 are upper and lower polar plates (not labeled), a circuit board 511, and a coil seat (not labeled). The circuit board 511 may have elements mounted in an area outside the stator seat 510 to reduce the thickness of the stator seat 510 as well as the overall thickness of the heat dissipating fan. The fan wheel 520 includes a main body (not labeled) with a peripheral wall (not labeled) and an axle 521 located at a center of the main body. The axle 521 is rotatably received in the stator seat 510. A number of upper blades 522 and a number of lower blades 524 are spacedly provided along the peripheral wall of the fan wheel 520. In this embodiment, the upper blades 522 and the lower blades 524 are separate and alternately disposed. In addition, each upper blade 522 is connected to the peripheral wall of the fan wheel 520 at an end edge 523 that extends in a direction at an angle with an axial direction of the axle 521. Each lower blade 524 is a connected to the peripheral wall of the fan wheel 520 at an end edge 525 that extends in a direction substantially parallel to the axial direction of the axle 521.

The lid 530 includes an air inlet 531 and a number of hooked fastener 532 for releasable engagement with the notches 504 of the casing 500. Referring to FIG. 18, most of each upper blade 522 extends upwardly beyond the lid 530, while the lower blades 524 are below the lid 530.

When the miniature heat dissipating fan is applied to a notebook computer, since most of each upper blade 522 extends beyond the lid 530, the level of the lid 530 can be lowered, which is advantageous in a limited space. In addition, a larger gap between the lid 530 and the notebook computer housing is obtained (see FIG. 5 for reference). Accordingly, ambient air may enter the air inlet 531 of the lid 530 via a larger gap. This may largely prevent the air from being slowed down resulting from viscous flow when passing through a small gap. In addition, since each upper blade 522 extends beyond the lid 530, the active area of the upper blades 522 increases, i.e., the amount of air driven by the upper blades 522 is increased. Furthermore, the upper blades 522 may drive ambient air into the air inlet 531 along the axial direction of the axle 521. Preferably, each upper blade 522 is substantially rectangular to provide a maximal active area. Furthermore, the upper blades 522 may drive ambient air into the air inlet 531 along the axial direction of the axle 521. The lower blades 524 are below the lid 530. Ambient air that has been driven into the casing 500 by the upper blades 522 is driven by the lower blades 524 along a plane perpendicular to the axial direction of the axle 521, thereby forming a circulating air flow.

In operation, upon rotation of the fan wheel 520, ambient cool air is sucked into the casing 500 by the upper blades 522 via the gap between the computer housing and the lid 530 and the air inlet 531 of the lid 530 and driven along the axial direction of the axle 521 to carry heat in the casing 500 away. Then, hot air as a result of absorbing heat generated inside the notebook computer is driven by the lower blades 524 along a plane perpendicular to the axial direction of the axle 521 to exit the casing 500 via the air outlet 503.

Figure 19:
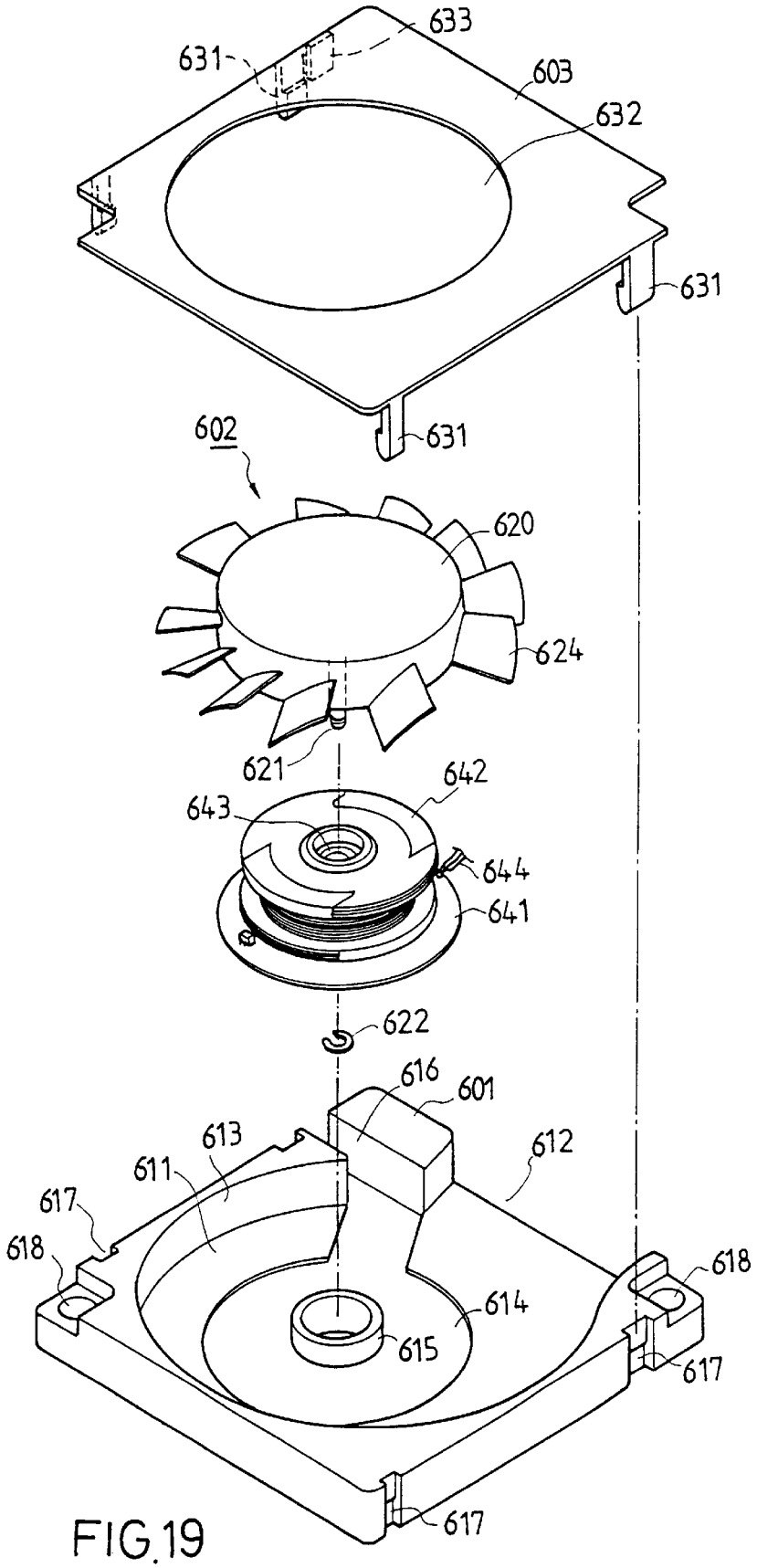
FIG. 19 is an exploded perspective view of a sixth embodiment of a miniature heat dissipating fan in accordance with the present invention.
Figure 20:
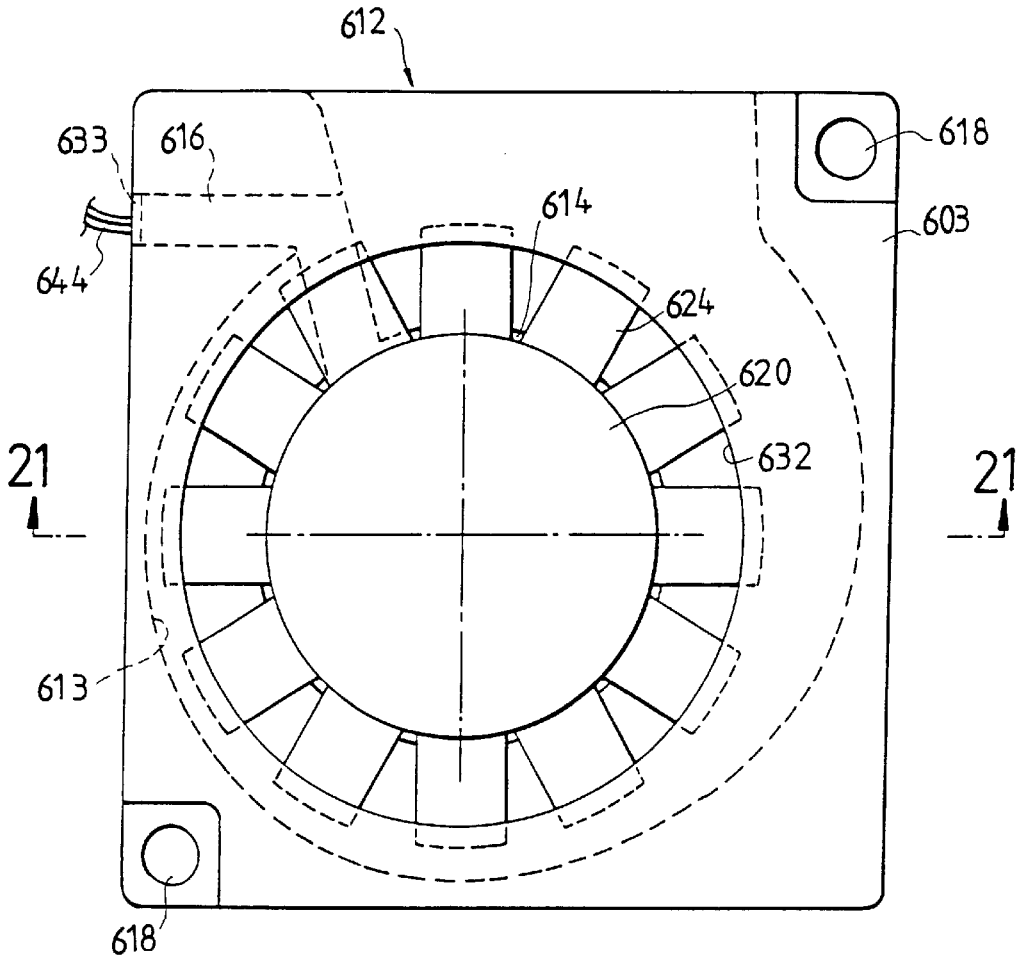
FIG. 20 is a top view of the miniature heat dissipating fan in FIG. 19.
Figure 21:
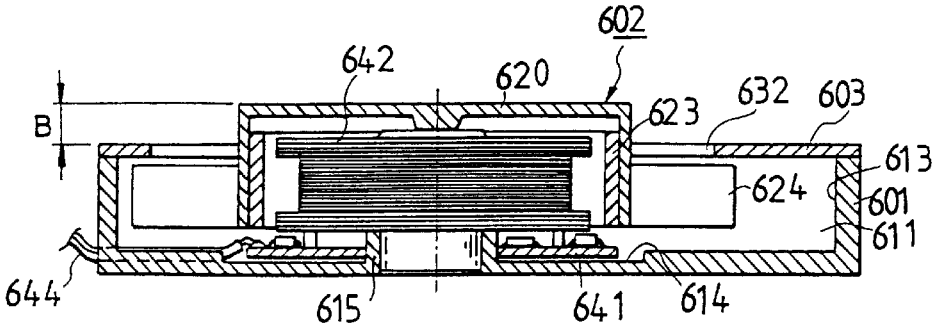
FIG. 21 is a sectional view taken along line 21—21 in FIG. 20.

Referring to FIGS. 19 to 21, a sixth embodiment of a miniature heat dissipating fan in accordance with the present invention generally includes a casing 601, a stator seat 642, a fan wheel 602, and a lid 603. The casing 601 includes a compartment 611 and a channel 616. The channel 616 allows insertion of wires 644 on a circuit board 641 and a coil seat (not labeled) mounted on the stator seat 642. The compartment 611 is defined by a bottom wall and an arcuate wall 613 that extends for about a half of a circle. The bottom wall includes a recessed area 614, which, in turn, has an axle tube 615 formed thereon, which will be described later. The casing 601 further includes an air outlet 612 defined in a periphery thereof The casing 601 further includes a number of notches 617 defined in a periphery thereof, which will be described later. The casing 601 further includes a number of positioning holes 618 through which fasteners (not shown) are extended so as to fix the miniature heat dissipating fan to an appropriate place.

The stator seat 642 is mounted in the compartment 611 and fixed to the axle tube 615 of the casing 601. Mounted on the stator seat 642 are upper and lower polar plates (not labeled), a circuit board 641, and a coil seat (not labeled) that has a bearing 643 mounted therein. The fan wheel 602 includes a main body 620 with a peripheral wall (not labeled) and an axle 621 located at a center of the main body. The axle 621 is rotatably supported by the bearing 643 of the stator seat 642 and is retained in place by a C-clip 622. A ring magnet 623 (FIG. 21) is mounted to an inner periphery of the main body 620. The fan wheel 602 may be rotated upon magnetic induction by the ring magnet 623 around the coil seat. A number of blades 624 are annularly and spacedly provided along the peripheral wall of the fan wheel 602. Each blade 624 has a height lower than that of the main body 620 and also lower than that of the arcuate wall 613 of the casing 601. In addition, each blade 624 is located adjacent to a lower edge of the main body 620 such that each blade 624 has a distance to the upper edge of the main body 620. More specifically, the main body 620 may be partially extended through an opening 632 of the lid 630.

In addition to the opening 632, the lid 603 includes a number of hooked fasteners 631 for releasable engagement with the notches 617 of the casing 601. Referring to FIG. 21, the main body 620 is partially extended through an air inlet 632 of the lid 630 such that the top surface of the main body 620 has a distance "B" to the lid 603. The gap between the lid 630 and the main body 620 forms an air inlet for the fan. The lid 603 further includes a peg 633 that extends downwardly to retain the wires 644.

In assembly, the stator seat 642 having the circuit board 641 and the coil seat thereon is mounted to the axle tube 615 of the casing 601, and the axle 621 of the fan wheel 602 is rotatably received in the axle tube 615. Preferably, the axle 621 is located in an eccentric location relative to the arcuate wall 613 so as to form a helical passage, i.e., the blades 624 of the fan wheel 602 are distal to the air outlet 612. More specifically, the blades 624 of the fan wheel 602 and the arcuate wall 613 that defines the compartment together define an eccentric helical air passage having a width that increase gradually toward the air outlet 612. After mounting the fan wheel 602 to the coil seat, the lid 603 is attached to the casing 602 in a manner that the main body 620 partially extends beyond the opening 632 of the lid 603.

It is appreciated that the casing, the stator seat, the fan wheel, and the lid can be made of light, rigid material. In addition, the thickness of each element is minimized to thereby provide a light miniature heat dissipating fan with minimized thickness.

In order to provide a better air circulation for heat dissipation, the channel for power lines of the casing is blocked after the hooked fasteners of the lid are engaged with the notches of the casing. Thus, the heat dissipating fan has no other openings except the air inlet and air outlet(s). Accordingly, ambient air is driven into the casing via the air inlet to carry heat in the casing away via the air outlet(s). The casing may be made of material with excellent heat conductivity such that heat from a heat source (e.g., an integrated circuit of e.g., a notebook computer) is conducted to an interior of the casing to allow subsequent heat dissipation by rotation of the fan wheel. The air outlet(s) of the casing provides a circulating effect for convection.

The circuit board of the stator seat may have elements mounted in an area outside the stator seat to reduce the thickness of the stator seat as well as the overall thickness of the heat dissipating fan.

Upper edges of the blades extend beyond the lid such that the level of the lid can be lowered, which is advantageous in a limited space. In addition, a larger gap between the lid and the computer housing is obtained. Accordingly, ambient air may enter the air inlet of the lid via a larger gap. In addition, the active area of the blades is increased to increase the amount of air driven by the blades. The lid and the blades in accordance with the present invention provide increased circulating air flow, increased air amount driven by the blades, and reduced noise.

The fan wheel may include a number of blades each having an upper section and a lower section. The upper section of each blade is connected to the fan wheel at an arcuate end edge that extends in an angle with an axial direction of the axle. The lower section of each blade is connected to the fan wheel at a rectilinear end edge that extends along the axial direction of the axle. When the fan wheel rotates, the upper sections of the blades generate an air flow along the axial direction, while the lower sections of the blades generate an air flow perpendicular to the axial direction. Thus, upon rotation of the fan wheel, a circulating convection effect is obtained in the casing. The upper and lower sections of the blades provide increased circulating effect and increased air amount driven by the blades.

Although the invention has been explained in relation to its preferred embodiment, it is to be understood that many other possible modifications and variations can be made without departing from the spirit and scope of the invention as hereinafter claimed.

What is claimed is:

1. A heat dissipating fan comprising:

a casing including a compartment, a bottom wall that defines the compartment having an axle tube formed thereon, the casing further including an air outlet defined in an end edge thereof and communicated with the compartment;

a stator seat mounted to the axle tube;

a fan wheel mounted in the compartment and including a number of blades and an axle, the axle being rotatably received in the axle tube; and a lid engaged on top of the casing and including an air inlet, each said blade being partially extended beyond the air inlet via the air inlet, said fan wheel including an upper end also partially extended beyond the air inlet;

whereby when the fan wheel rotates, ambient air is driven into the casing via the air inlet and exits the casing via the air outlet.

2. The miniature heat dissipating fan as claimed in claim 1, wherein each said blade includes an upper edge extended in a direction at an angle with an axial direction of the axle, said upper edge having a portion extended beyond the lid, while the remaining portion of the upper edge being inside the air inlet.

3. The miniature heat dissipating fan as claimed in claim 1, wherein said lid includes a recessed area around the air inlet, each said blade including an upper edge extended beyond the lid, while the remaining portion of the upper edge being extended into the recessed area of the lid.

4. The miniature heat dissipating fan as claimed in claim 1, wherein each said blade includes an upper section and a lower section, the upper section being extended in a direction at an angle with an axial direction of the axle, and the lower section being extended in a direction parallel to the axial direction of the axle.

5. The miniature heat dissipating fan as claimed in claim 1, wherein each said blade including an upper section and a lower section having an outer diameter greater than that of the upper section.

6. A heat dissipating fan comprising:

a casing including a compartment, a bottom wall that defines the compartment having an axle tube formed thereon, the casing further including an air outlet defined in an end edge thereof and communicated with the compartment;

a stator seat mounted to the axle tube;

a fan wheel mounted in the compartment and including a number of upper blades, a number of lower blades, and an axle, each said upper blade extending in a direction at an angle with an axial direction of the axle, each said lower blade extending in a direction parallel to the axial direction of the axle, the axle being rotatably received in the axle tube; and a lid engaged on top of the casing and including an air inlet, each said upper blade being extended beyond the air inlet via the air inlet, each said lower blade being located below the lid;

whereby when the fan wheel rotates, ambient air is driven into the casing via the air inlet and exits the casing via the air outlet.

7. The miniature heat dissipating fan as claimed in claim 6, wherein each said lower blade has an outer diameter greater than that of each said upper blade.

8. The miniature heat dissipating fan as claimed in claim 6, wherein said fan wheel includes a peripheral wall, and wherein said upper blades and said lower blades are alternately disposed on the peripheral wall.

9. The miniature heat dissipating fan as claimed in claim 6, wherein said lid includes a recessed area around the air inlet, said lower blades being extended into the recessed area of the lid.

10. A miniature heat dissipating fan comprising:

a casing including a compartment and an air outlet communicating with the compartment, a wall means that defines the compartment including an arcuate wall and a bottom wall, the bottom wall including an axle tube formed thereon;

a coil seat mounted to the axle tube;

a circuit board mounted to the axle tube;

a fan wheel including a main body and an axle, the axle being rotatably received in the axle tube, the main body including an outer periphery, an inner periphery, a lower edge, and a top surface, a ring magnet being securely mounted to the inner periphery of the main body, a number of blades being mounted to the outer periphery of the main body and adjacent to the lower edge of the main body, each said blade having a height lower than that of the arcuate wall and also lower than that of the main body; and a lid mounted on top of the casing and including an opening through which the main body of the fan wheel is extended beyond the lid such that the top surface of the main body is spaced a distance from the lid, and the fan wheel and an inner edge that defines the opening of the lid together define an air inlet, wherein the lid further includes a recessed area around the air inlet, and the recessed area of the lid has a thickness smaller than that of the remaining portion of the lid.

11. The miniature heat dissipating fan as claimed in claim 10, wherein the blades of the fan wheel and the arcuate wall that defines the compartment together define an eccentric helical air passage having a width that increases gradually toward the air outlet.

* * * * *